US005437379A

United States Patent [19]

Wolf et al.

[11] Patent Number: 5,437,379

[45] Date of Patent: Aug. 1, 1995

[54] MERCHANDISE DISPLAY ASSEMBLY

[76] Inventors: Morris A. Wolf, 7048 Macapa Dr., Los Angeles, Calif. 90068; Leo Wolf, 10355 Cheviot Dr., Los Angeles, Calif. 90064

[21] Appl. No.: 28,542

[22] Filed: Mar. 8, 1993

[51] Int. Cl.[6] ..... A47F 7/00

[52] U.S. Cl. ..... 211/169; 211/13; 211/175; 211/47

[58] Field of Search ..... 211/175, 151, 170, 40, 211/41, 47, 48, 169, 94.5, 162, 13; 312/9.9, 9.58, 9.61, 334.2, 330.1, 132, 133, 185

[56] References Cited

U.S. PATENT DOCUMENTS

| | | | |
|---|---|---|---|
| 1,707,614 | 4/1929 | Hudson | 312/132 X |
| 2,048,586 | 7/1936 | Anderl | 211/170 |
| 2,219,145 | 10/1940 | Wolf | 211/13 |
| 3,712,477 | 1/1973 | Kieves | 211/40 |
| 3,812,975 | 5/1974 | Gutierrez | 211/40 |
| 3,889,812 | 6/1975 | Gutierrez | 211/40 X |
| 4,781,292 | 11/1988 | Sacherman et al. | 211/40 X |

FOREIGN PATENT DOCUMENTS

| | | | |
|---|---|---|---|
| 22387 | 10/1903 | United Kingdom | 312/132 |

*Primary Examiner*—Robert W. Gibson, Jr.
*Attorney, Agent, or Firm*—Small Larkin & Kiddé

[57] ABSTRACT

A merchandise display assembly comprising a frame of posts and struts defining recesses for groups of mens' shirts, by sizes, each recess having a pair of display racks on an extendable slide. The display racks have hinged wickets comprising elongated, channel-shaped trays, with downturned end tabs pivoted to the sidewalls of bases of the racks, and upright supports formed by rods at each end bent to form front and rear legs for supporting the shirts. The front leg has a forward closed-loop bend at its upper end and the rear leg has a laterally offset V-shaped return for rear support, and an integral bend between the legs is clamped against the open end tab of the tray by a rivot which also forms the pivot. An individual rack also shown is for countertop use.

19 Claims, 2 Drawing Sheets

MERCHANDISE DISPLAY ASSEMBLY

BACKGROUND OF THE INVENTION

This invention relates to merchandise display racks for holding merchandise, typically folded shirts, in upright stored positions in which the merchandise is protected against crushing, and permitting easy separation of the merchandise for inspection and selection.

It has become customary in retail shops to store shirts in stacks, sometimes in bins or cubicles and sometimes simply on counters or in drawers, usually arranged in groups according to the sizes of the shirts. Typically, men's shirts will be grouped by neck size and sleeve length, for example, in stacks such as "16-32", "16-33", "16-34", etc. Size is the most important and the primary selection factor. Sometimes, either intentionally or because of mixing by customers, shirts of different sizes are mixed together into one stack.

Locating and inspecting a desired shirt can be difficult in such shops, and handling of the stack of shirts, once the desired group is formed, frequently is awkward. Frequently it is difficult to find the desired size, necessitating rummaging through the stacks. Sometimes it is necessary to pull a stack from a bin for examination after which the stack may be placed on the floor or a nearby unrelated display for convenience. Also, an individual shirt may be pulled from a stack, frequently being returned to the stack in disarray or even to the wrong stack. Moreover, such stacking frequently leads to unsightly crushing of the shirt collars.

Efforts have been made to provide for more convenient and effective display of such merchandise, ranging from individual pigeon holes in wall displays, not practical for mass merchandising, to a special shirt rack as disclosed in U.S. Pat. No. 2,160,050 for holding shirts in groups in upright positions on hinged wickets permitting purchasers to "leaf through" the shirts without removing them from the display. These shirt racks hold shirts in a convenient, grouped fashion and permit easy examination of the shirts, but never found widespread acceptance despite their obvious advantages, perhaps because of practical shortcomings in the design of the racks. These shortcomings included inadequate support for the shirts on the wickets and problems with catching of the merchandise on the wickets and in the hinge joints of the wickets.

The object of this invention is to provide a new and improved merchandise display rack having the features and advantages of the foregoing patented display rack, and without those practical shortcomings.

SUMMARY OF THE INVENTION

The present invention resides in an improved hinged-wicket merchandise display rack of the general type disclosed in the foregoing patent, in which the wickets of each rack are formed and mounted in a novel manner to receive the items of merchandise freely, easily and without danger of snagging on buttons or in other ways, and to support the merchandise securely without danger of sagging and positively protected against jamming in the hinge joints of the wickets. In addition, the invention resides in a novel assembly of a plurality of such hinged-wicket racks within a display frame supporting the racks in retracted positions within recesses in the frame and for selective extension out of the frame into easily accessible extended positions.

More specifically, in the preferred embodiment of the invention, each wicket comprises a lower end portion in the form of an elongated, channel-shaped tray disposed above the base of the rack and having a downwardly extending tab at each end lying alongside the base and pivotally connected to the sidewall of the base, the tray serving not only to provide support for the merchandise but also forming stops determining the forward and rearward positions of the wicket. The tray-and-tab configuration positions the pivots below the lowermost position of the merchandise, and insures that the merchandise is held clear of the moving parts.

In the presently preferred embodiment, each wicket has two elongated rods forming two supports at opposite ends of the tray, each having a front leg and a rear leg extending upwardly from the tray and defining a slot having an open upper end for receiving an item of merchandise. Each front leg has an enlarged upper end formed by a closed-loop bend on the front of the wicket, and each rear leg has an upwardly extending portion and an integrally joined and laterally offset downwardly extending return portion, thereby providing substantial width of support at each end of the tray., The return portion preferably has a broad V-shaped bend to increase the width of support.

For simplicity of construction, the front and rear legs of each of these wicket supports may compress a single rod or wire with an integral bend at the end of each tray. As shown herein, this bend extends along the tab on the tray and around the pivot, and is covered by a cap overlying the tab and clamped in place thereon by a fastener defining the pivot.

In the preferred embodiment of the display assembly, a plurality of display racks are disposed in recesses in a display frame, comprising upright posts and horizontal cross-struts between the posts, and are mounted on the frame for movement into extended positions for easy access. One or more racks are provided on a slide in each recess, preferably grouping the merchandise by sizes, which may be displayed on the front ends of the bases of the racks.

Other features and advantages of the invention will become apparent from the following detailed description, taken in conjunction with the accompanying drawings.

DETAILED DESCRIPTION OF PREFERRED EMBODIMENT

Figure 1:
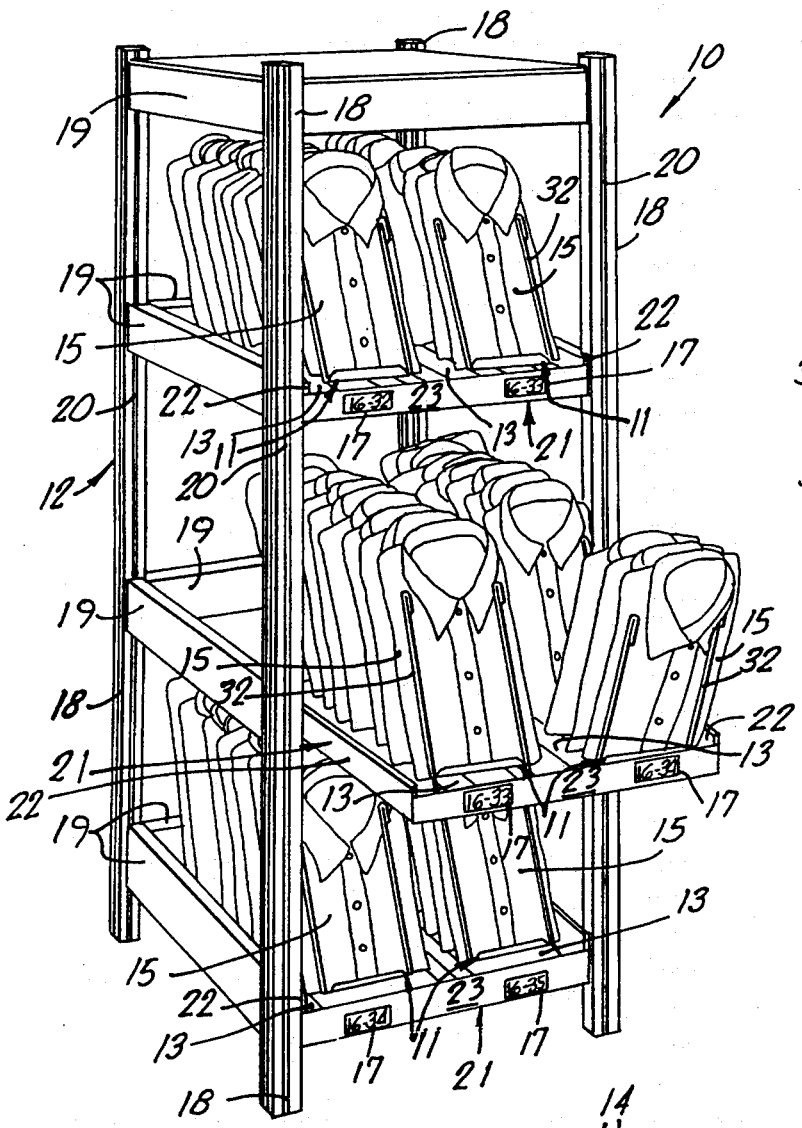
FIG. 1 is a front perspective view of a merchandise display assembly incorporating the novel features of the present invention, loaded with merchandise and with one group of two display racks shown in the extended position and with a portion of the wickets of one rack rocked forwardly from the normal, rearward storage position.
Figure 3:
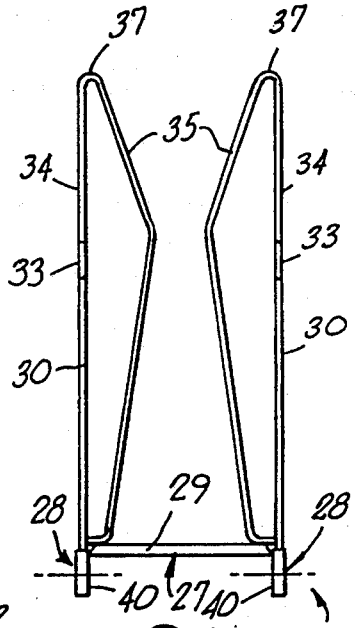
FIG. 3 is a front elevational view of one of the wickets.
Figure 2:
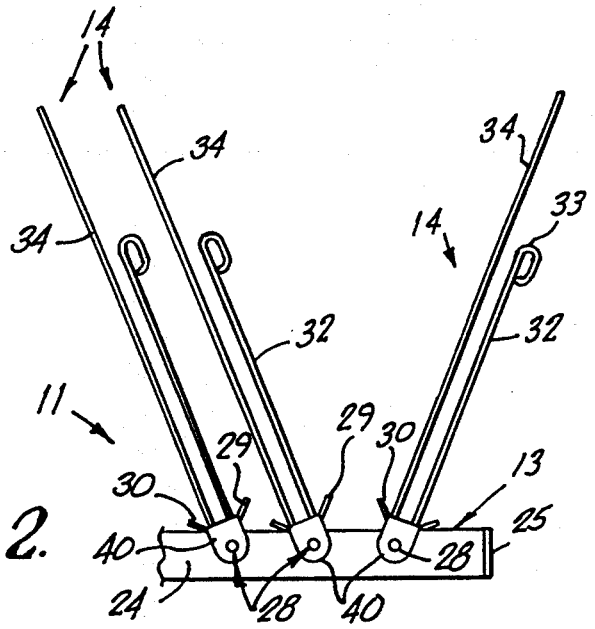
FIG. 2 is an enlarged fragmentary side elevational view of one of the racks, with parts in moved positions and with the merchandise removed.

As shown in the drawings for purposes of illustration, the invention is embodied in a new and improved merchandise display assembly, indicated generally by the reference number 10 in FIG. 1, for use in a retail store or shop and comprising a plurality of merchandise display racks 11 that are normally disposed in recesses in a display frame 12 (FIG. 1) and are movable into extended positions for easy access to the merchandise. Each of the display racks 11 of the assembly 10 generally comprises an elongated base 13 and a plurality of hinged wickets 14 in upright positions arranged in a front-to-rear row along the base and pivotally mounted at their lower ends for rocking forwardly and rearwardly between two angularly spaced positions, as seen most clearly in FIGS. 1 and 2.

The assembly 10 is designed primarily for use in displaying folded mens' shirts 15, as shown in FIG. 1, but may be used for other merchandise as well. The merchandising of mens' shirts presents special problems because of the sizing of such shirts by neck size and sleeve-length, as mentioned in the Background section. The preferred use of the assembly 10 is to group such shirts by sizes, with the sizes displayed at the bases of the display racks 11, as shown in FIG. 1, so that a prospective purchaser may go directly to shirts of the size that is needed. The illustrative assembly 10 has three cubicles or recesses containing two display racks 11 each, and a progression of sizes from "16-32" through "16-35" as indicated by the labels 17. Other assemblies (not shown) will be provided for the remaining sizes. The illustrative display frame 12 is formed by four upright posts 18 joined by transverse struts 19 along the sides and rear of the cubicles, the front of the frame being open. The posts and the struts may be of the type shown in prior U.S. Pat. Nos. 4,712,286 and 4,607,754, the posts having grooves 20 into which couplers (not shown) on the struts connect to form a rigid framework.

Forming the lower side of each of the recesses in the assembly 10 is a slide or tray 21 that is movably supported between two struts 19 in drawer-like fashion for movement between the extended and retracted positions shown in FIG. 1. Various supporting means (not shown) may be provided, ranging from simple interfitting tracks to roller drawer guides of conventional types acting between the struts and the sides 22 of the slides. These sides are connected across their fronts by crossbars 23 across the front ends of two racks supported on the slide. A similar crossbar (not shown) may be provided to connect the sides across the rear end of each slide.

Each display rack 11 has an elongated base 13 which may be a simple rectangular box with a flat top wall and relatively narrow side walls 24 and end walls 25. The width of the base is slightly less than the width of the folded shirts, and the length is sufficient to support the desired number of shirts on the rack, typically eight to twelve.

Figure 4:
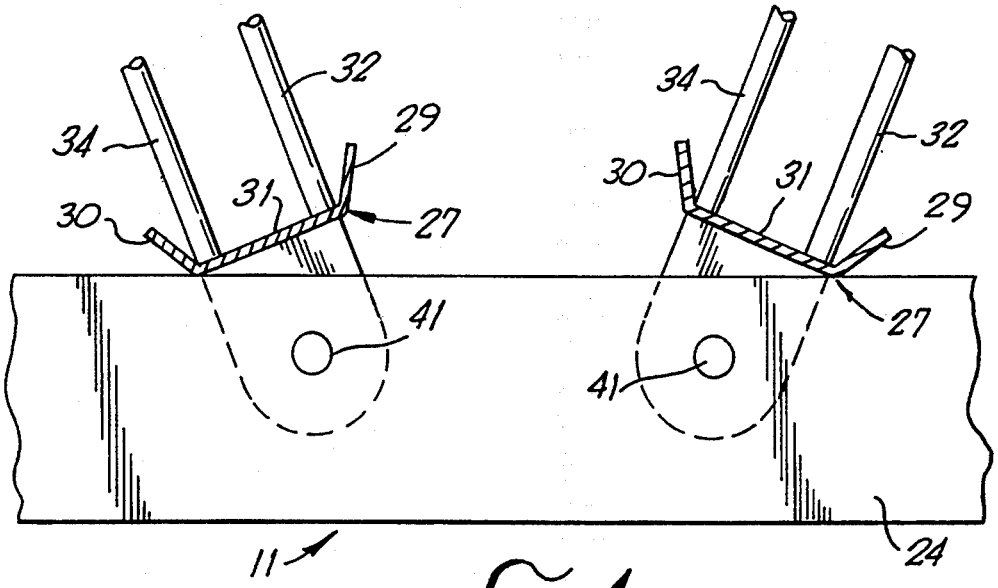
FIG. 4 is a further enlarged fragmentary cross-sectional view taken in a longitudinal plane through a portion of FIG. 2.
Figure 5:
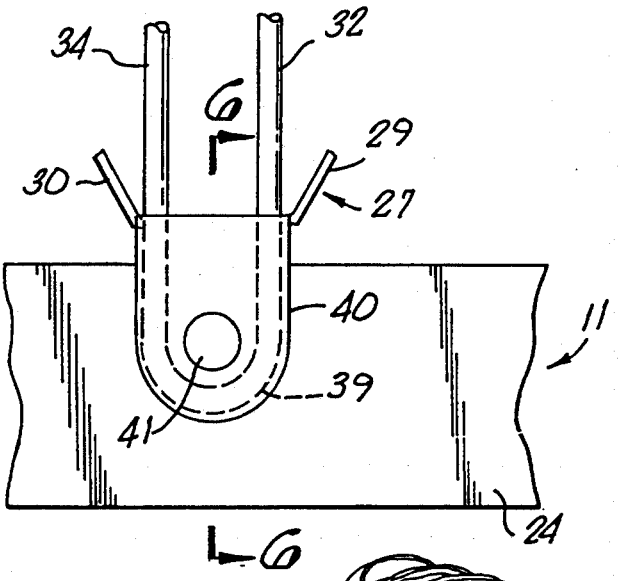
FIG. 5 is a fragmentary side elevational view of the lower end portion of one of the wickets in FIG. 2, also on an enlarged scale, showing the wicket in an intermediate position.
Figure 6:
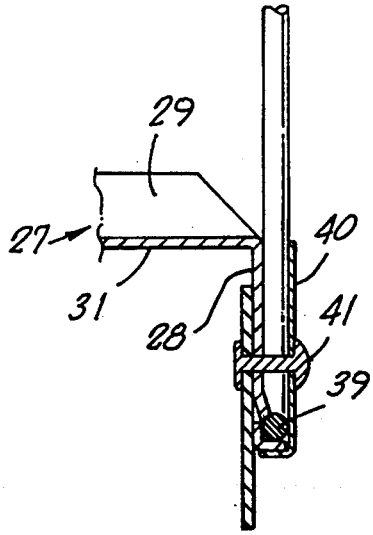
FIG. 6 is a fragmentary cross-sectional view taken along line 6—6 of FIG. 5.

In accordance with one aspect of the invention, the wickets 14 have lower ends in the form of elongated channel-shaped trays 27 that are positioned above the base 13 by tabs 28 that extend downwardly from opposite ends of the trays and are pivotally connected to the sidewalls 24. Each tray has front and rear flanges 29 and 30 on opposite sides of an elongated bottom wall 31 (FIGS. 4–6), the tabs being downturned extensions of this bottom wall.

To hold the shirts 15 upright, each wicket 14 has front and rear holding members defining an upwardly opening slot for receiving a folded shirt and supporting it securely in place. In the presently preferred embodiment, the holding members are two elongated rods at opposite ends of the tray, each having front and rear portions for engaging the front and rear sides of a shirt. As can be seen in the drawings, the front portion is a length 32 of the rod that extends upwardly a distance substantially shorter than the height of the folded shirt for ease of insertion and removal of shirts, with an enlarged and rounded upper end 33 formed by a forward closed-loop bend. The rear portion is a second length 34 of the rod that extends upwardly along the rear of the merchandise, preferably farther than the front length 32 for higher support, and also having a return 35 that is spaced laterally from the length 34. The returns of the two supports herein are broad V-shaped bends, with apexes that are spaced only a short distance apart, thereby providing secure support across substantially the full width of the shirt. The upper end of each rear portion is a rounded bend 37, and the lower end of each return 35 is joined to the lower end of the rod 32, for rigidity of the support.

To secure the two supports in their upright positions on the tray 27, the two legs or lengths 32 and 34 of each support are joined together by an integral bend 39 (FIG. 5), positioned alongside the tab 28 at the end of the tray, and are covered by a tab cap 40 (see FIG. 6) that overlies the tab 28 and the bend 39. The pivots are formed by fasteners 41, herein rivets extending through the tab caps and the tabs and clamping them together around the bends 39, and also extending through the sidewall 24 of the base 23 to make the pivotal connection for the wicket. The two rivets at opposite ends of the tray lie along and define a common axis for the wicket 14.

These one-piece wicket supports are an advantageous means of support, using one elongated rod at each end of the wicket, the rod being either metal or plastic. It will be apparent, however, that molded plastic parts can be provided to perform the same supporting function as the tray and the two rods, and that the assembly operation can be simplified and costs reduced by doing so.

As can be seen in the drawings, and particularly in FIGS. 4 through 7, the trays 27 provide secure support for the merchandise 15, with the flanges 29 and 30 providing positive retention in a front-to-rear direction, along with the front and rear support rods 32 and 34. At the same time, the merchandise 15 can extend beyond the ends of the trays, and beyond the pivots 41, through the open ends of the trays, but still is positively protected against jamming in the hinges formed by the rivets 41. There is no way that the merchandise can sag or become jammed or damaged.

Most importantly, the merchandise is attractively displayed in sorted and labeled groups of various sizes that are readily accessible by sliding them out of their recesses, and access to the individual items of each group is very easy. The prospective purchaser can simply leaf through the series, tilting one after another for inspection, or can go directly to a selected item that is of interest. This permits the close examination of any item of a selected color or pattern, within the selected size group.

Also, it should be noted that the individual labels of the shirts can be seen without removing a shirt from its wicket. And all of this is accomplished in a merchandise display rack that also maintains the merchandise in organized, attractive and uncrushed condition.

Figure 7:
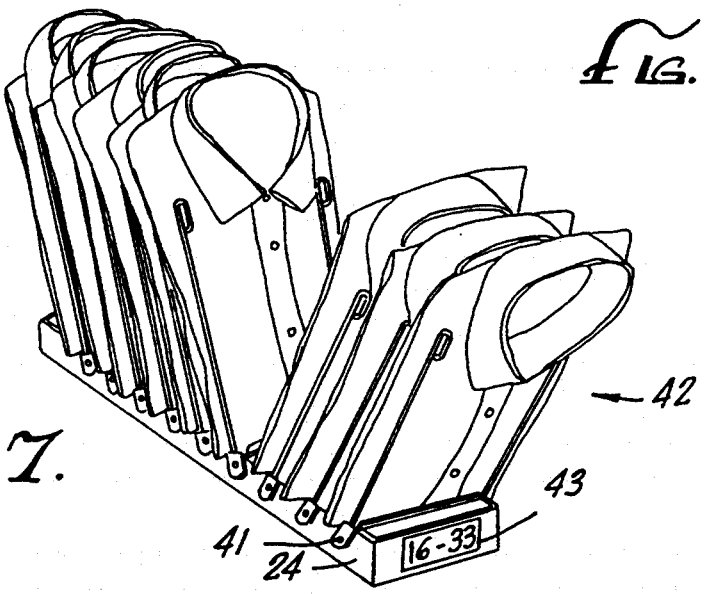
FIG. 7 is a perspective view similar to a portion of FIG. 1 showing an individual display rack capable of countertop or other use.

Shown in FIG. 7 is a single merchandise display rack 42 that can be placed, by itself, on a countertop or other support (not shown). This rack can be identical in all other respects to the racks shown in FIGS. 1–6, so corresponding parts are identified by the same reference numbers. The only notable difference is that the label 43 in this embodiment is applied directly to the endwall 25 of the base 13 rather than to the front edge of a slide 21.

From the foregoing, it will be evident that the present invention provides a new and improved merchandise display assembly 10 and rack 11 for the attractive, organized display of merchandise such as shirts 15, for greater ease and convenience of the customer in shopping. It also will be evident that, while a particular embodiment of the invention has been illustrated and described with particularity, various modifications and changes may be made by those skilled in the art without departing from the spirit and scope of the invention.

We claim as our invention:

1. A merchandise display assembly for holding a plurality of groups of merchandise in stored positions and presenting each group for access and individual inspection of the items of merchandise in that group by a prospective purchaser, said display assembly comprising:

a plurality of display racks each comprising an elongated base adapted to be disposed in a horizontal position and having a plurality of upstanding merchandise-holding wickets on the base, said wickets being pivotally mounted at their lower ends on the base for rocking back and forth longitudinally of the base between forward and rearward angularly spaced positions, and each having support means including an elongated, channel-shaped tray extending across the lower end of the wicket for supporting the lower edge of an item of merchandise thereon and having upstanding front and rear holding members on the support means for engaging the front and rear sides of the item of merchandise, said holding members having spaced upper ends for insertion and removal of the merchandise;

each of said trays of said wickets having two downturned tabs at its opposite ends straddling the base of the display rack and pivotally connected thereto to support the wicket above the base for pivoting between said forward and rearward positions;

and a display frame having frame members defining a plurality of recesses for said display racks, each of said display racks being disposed in a retracted position in one of said recesses and movable relative to said display frame for extension from the retracted position out of the display frame into an extended position for inspection of the merchandise on the rack;

said display racks and said wickets being disposed substantially outside of said display frame when in said extended positions for access to the wickets by prospective purchasers, whereby rocking of the wickets in front of any particular item to the forward positions exposes that item to the purchaser for inspection and removal.

2. A merchandise display assembly as defined in claim 1 wherein said display unit comprises a frame of upright front and rear posts with transverse struts connecting the front and rear posts along the lower boundary of each of said recesses, said display racks having bases slidably supported between two lateraly spaced struts.

3. A merchandise display assembly as defined in claim 2 wherein said display racks are mounted in side-by-side pairs on a common slide between two cross-struts.

4. A merchandise display assembly as defined in claim 1 wherein said support means of said wickets comprise elongated channel-shaped trays having bottom walls for engaging the lower edges of the merchandise and front and rear flanges along said bottom walls for holding the merchandise on the wicket.

5. A merchandise display assembly as defined in claim 1 wherein said front and rear holding members comprise a pair of elongated rods having front and rear portions extending upwardly from opposite ends of said support means and defining a slot having an open upper end for receiving the merchandise, the front portions having integral loop-shaped bends forming enlarged upper ends for preventing catching of the merchandise, and the rear end portions comprising two laterally spaced lengths of the rods along each side joined by integral bends at the upper ends providing support for the rear side of the merchandise on each side of the wicket.

6. A merchandise display assembly as defined in claim 4 wherein each of said bases is an elongated rectangular member having a width less than the length of said trays and including a top surface and depending sidewalls, and wherein the tabs on the ends of each tray straddle the base and lie alongside said sidewalls, each tab being pivotally connected to the base by means of a fastener extending through the tab and through the sidewall of the base.

7. A merchandise display assembly as defined in claim 6 wherein each tab comprises a downturned extension of the bottom wall of the tray lying alongside one of said sidewalls, and a tab cover overlying said extension in spaced relation therewith, said holding members having lower end portions clamped in said tabs between said extensions and said covers and held in place therein by said fasteners.

8. A merchandise display assembly as defined in claim 7 wherein each of said wickets has opposite side portions comprising a rod having a rear leg upstanding from one of said tabs adjacent the rear side of a tray and a front leg upstanding from said one tab along the front side of the tray, said front and rear legs being integrally joined by a bend within said one tab extending around the fastener.

9. A merchandise display assembly as defined in claim 8 wherein said fasteners hold said trays a preselected distance above said top surface of said base, whereby said fasteners support the trays for rocking between forwardly and rearwardly inclined positions.

10. In a merchandise display rack having a base adapted to be disposed in a horizontal position and a plurality of merchandise-holding wickets for extending upwardly from said base and rocking back and forth between two angularly spaced positions, the improvement which comprises:

each of said wickets having a lower end portion in the form of an elongated, channel-shaped tray disposed above said base and having a tab at each end extending downwardly to the base, each of said trays comprising a bottom wall for engaging the lower edge of an item of merchandise and front and rear flanges for retaining the merchandise on the wicket;

and a pivot between said tabs and said base supporting said trays above said base for rocking between said two positions, said trays having front and rear edges forming stops engageable with said base to limit rocking in said two positions.

11. A merchandise display rack as defined in claim 10 wherein each of said wickets comprises a pair of elongated rods having front and rear portions extending upwardly from opposite ends of a tray and defining a slot having an open upper end for receiving the merchandise, the front portion of each of said rods having an enlarged upper end for preventing catching of the merchandise.

12. A merchandise display rack as defined in claim 11 wherein said enlarged upper end is formed by a loop-shaped bend in the rod.

13. A merchandise display rack as defined in claim 11 wherein the rear portion of each rod comprises two laterally spaced lengths of the rod joined by an integral bend at the upper end, thereby providing a support on each side of the wicket for holding the rear side of the merchandise.

14. A merchandise display rack as defined in claim 11 wherein the rods of said wickets are composed of wire.

15. A merchandise display rack as defined in claim 11 wherein said wickets are plastic.

16. A merchandise display rack as defined in claim 10 wherein said base is an elongated rectangular member having a width less than the length of said trays and including a top surface and depending sidewalls, and wherein the tabs on the ends of each tray straddle the base and lie alongside said sidewalls, each tab being pivotally connected to the base by means of a fastener extending through the tab and through the sidewall of the base.

17. A merchandise display rack as defined in claim 16 wherein each tab comprises a downturned extension of the bottom wall of the tray lying alongside one of said sidewalls, and a cover overlying said extension in spaced relation therewith, said wickets having lower end portions clamped in said tabs between said extensions and said caps and held in place therein by said fasteners.

18. A merchandise display rack as defined in claim 17 wherein each of said wickets has opposite side portions comprising a rod having a rear leg upstanding from a tab adjacent the rear side of a tray and a front leg upstanding from the tab along the front side of the tray, said front and rear legs being integrally joined by a bend within the tab extending around the fastener.

19. A merchandise display rack as defined in claim 16 wherein said fasteners support said trays a preselected distance above said top surface of said base, whereby said fasteners support the trays for rocking between forwardly and rearwardly inclined positions.

* * * * *